United States Patent [19]

Moore

[11] 4,327,364

[45] Apr. 27, 1982

[54] APPARATUS FOR CONVERTING INCIDENT MICROWAVE ENERGY TO THERMAL ENERGY

[75] Inventor: Richard L. Moore, Cleveland, Okla.

[73] Assignee: Rockwell International Corporation, El Segundo, Calif.

[21] Appl. No.: 972,195

[22] Filed: Dec. 22, 1978

[51] Int. Cl.[3] ..... H01Q 17/00

[52] U.S. Cl. ..... 343/18 A; 343/5 R

[58] Field of Search ..... 343/18 A, 5 R

[56] References Cited

U.S. PATENT DOCUMENTS 3,887,920 6/1975 Wright et al. ..... 343/18 A 4,012,738 3/1977 Wright ..... 343/18 A

FOREIGN PATENT DOCUMENTS 665747 1/1952 United Kingdom ..... 343/18 A 814310 6/1959 United Kingdom ..... 343/18 A

*Primary Examiner*—S. C. Buczinski

*Attorney, Agent, or Firm*—Charles T. Silberberg; Leonard Tachner

[57] ABSTRACT

A radar false target elimination system for converting incident microwave electromagnetic energy to thermal energy to preclude reflection of radar energy which would otherwise induce the generation of a beacon response and a false target from an aircraft being tracked by the radar. The invention comprises a layered, sandwich configuration of materials, including an electrical component sheet having a coating of a combination of carbon and polymide resin in a selected ratio by weight on a low dielectric constant and loss tangent substrate and in a selected geometrical configuration to provide a lossy mixture for achieving the aforesaid energy conversion.

The panel comprising such a sandwich configuration is mounted on potentially reflective structures in the vicinity of the radar which would otherwise permit reflections of radar energy along a false path to an aircraft. The panels are mounted substantially normal to the path between the otherwise reflecting surface and the radar antenna to maximize the energy conversion characteristics.

8 Claims, 8 Drawing Figures

APPARATUS FOR CONVERTING INCIDENT MICROWAVE ENERGY TO THERMAL ENERGY

BACKGROUND OF THE INVENTION

This invention relates generally to electromagnetic energy absorbers, and more specifically to a radar energy absorber system that is used to eliminate false radar targets created by electromagnetic radar reflections from structures in the proximity of the radar. Such false targets are a hazard to air traffic safety and a source of confusion to air traffic controllers.

Air traffic control radar beacon systems (ATCRBS) serve a multiplicity of functions including aircraft identification and location, presentation of ground speed and altitude and other aircraft parameters. The operations, functions and general considerations of air traffic control radar beacon systems are discussed in the text entitled, "Introduction to Radar Systems" by M. I. Skolnik published by McGraw Hill in 1962. Further refinement and utility of the air traffic beacon system has been provided through the application of the Automated Radar Terminal System (ARTS) wherein a coded transponder response is processed by computer to attach identifying "flags" with appropriate information on the radar indicator for immediate controller use.

With increasing airport congestion, and with the use of ARTS, one problem that has become increasingly significant is that of false targets or ghost targets created by interrogator-transponder communication over a reflected signal path. Structures in the proximity of the radar provide alternative communication paths between the aircraft and the controller. As a result, a ghost or virtual image of a true target is presented on the radar indicator with its range determined by the time of propagation and its azimuth determined by the direction in which the radar antenna is pointing when reflections from the structure illuminate the true target. The resultant presentation is not that of the true target, but rather that of a false target generated by inadvertant interrogation of the aircraft beacon via the reflective structure.

DESCRIPTION OF THE PRIOR ART

There are existing prior art methods for minimizing this problem as exemplified by the following:

1. Constructing reflective screens to redirect the reflected energy in some less troublesome direction;
2. Relocating the radar; and
3. Utilizing software discrimination.

Reflective screens have been constructed between the radar antenna and the reflective structure to redirect the electromagnetic energy to a less troublesome region. However, the coherency of the energy is not eliminated by this technique and objects passing through the redirected field still provide false radar targets. The screens must be very large with respect to the wavelength of the radar signal in order to be effective, and consequently, they present a substantial construction and maintenance problem. In addition, the screens are difficult to keep clean and are architectural problems.

A radar may be relocated to a remote site away from all reflective structures. However, this is a very expensive process and is not likely to be satisfactory because the surrounding terrain is frequently developed as the public need grows, and structures which may cause ghosts due to reflections are eventually constructed too close to the radars.

In software discrimination the air traffic control radar is programmed to send specific characteristics of a detected target, to compare those characteristics with a set of criteria to describe a true target, and to reject as false those targets which do not conform to those criteria. However, this system is not completely reliable and there is an inherent possibility of rejection of a true target that may result in the degradation of air safety. Accordingly, this solution is also rendered generally unacceptable.

The present invention solves the false target problem discussed above, while overcoming the noted disadvantages of the prior art. This is accomplished by providing an absorber system which requires no energy input, but which has the capability to destroy the coherency of the electromagnetic energy by transforming it into thermal energy. Thus, by an arrangement of passive electrical circuitry which accepts incident electromagnetic energy from air traffic control radars and converts a sufficient amount of that energy to non-coherent thermal energy, the radar presentation of false targets is substantially eliminated. As a result, reflection originating ambiguities in radar monitor scope presentations of targets shown in two locations, one true and one false, are removed by elimination of the false target. Air traffic safety is enhanced by elimination of these ambiguities, and a source of confusion is eliminated for air traffic controllers who are responsible for directing traffic around all targets but who are otherwise without the capability to confidently discern which of the targets are false and which are true.

These clearly advantageous results are achieved in the present invention by the use of an energy conversion device which possesses the additional advantageous features of being sturdy, durable, capable of long service life in severe atmospheric environment, does not require regular maintenance, is readily and economically fabricated on a mass production basis, and incorporates properties which provide an acceptable architectural blend for virtually any installation.

The present invention comprises a layered, sandwich configuration of materials including an electrical component sheet in which a coating of specific conductivity and geometrical configuration is deposited on a dielectric substrate; and a ground plane comprising a conductive wire mesh, the ground plane and electrical component sheet being separated by a spacer comprising a low dielectric material of precise thickness to provide a precise separation between the electrical component sheet and the ground plane. The combination of an electrical component sheet, ground plane and spacer is covered with face-skins which comprise fiberglass and resin in an appropriate combination to provide structural rigidity and an appropriate surface for transferring internally generated thermal energy into the atmosphere. The combination is sealed on both sides with a moisture impervious film. In one embodiment, the energy conversion device of the present invention is constructed into the form of 3 foot $\times$ 9 foot panels.

It is therefore an object of the present invention to provide an energy conversion system for the elimination of radar false targets which otherwise occur as a result of radar energy reflection from structures in the proximity of a radar antenna.

It is a further object of the present invention to provide an energy conversion device which eliminates the reflection of incident radar energy by converting it into thermal energy which is then dissipated into the surrounding atmosphere.

It is still a further object of the present invention to provide a radar energy conversion device which may be fabricated on a mass production basis and which is sturdy, durable, capable of long service life in severe atmospheric environment, which does not require frequent maintenance, and which provides an acceptable architectural blend for installation on structures in the vicinity of a radar.

BRIEF DESCRIPTION OF THE DRAWINGS

Other objects and advantages of the present invention will become apparent from the following detailed description when considered in conjunction with the accompanying drawings in which.

DETAILED DESCRIPTION OF A PREFERRED EMBODIMENT

Figure 1:
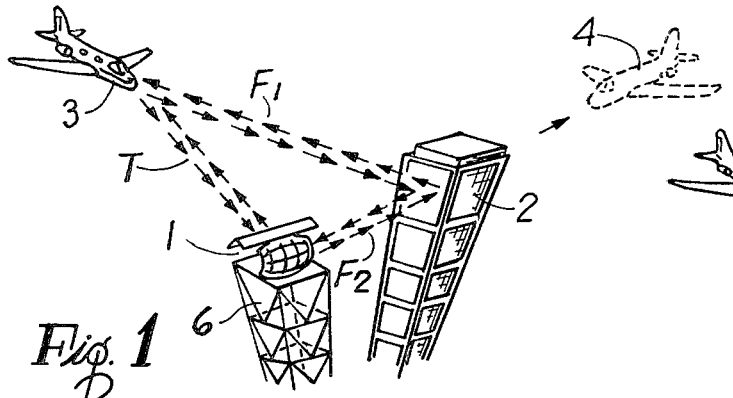
FIG. 1 is an illustrative representation of the problem solved by the present invention.

The problem solved by the present invention is illustrated in FIG. 1 wherein a radar system 1 mounted on an appropriate support structure 6 is located in the vicinity of a structure 2, such as an airport control tower or other such structure of sufficient height and proximity to radar 1 to cause the reflection problem described herein. As illustrated in FIG. 1, radar 1 detects an incoming aircraft 3 by means of radar energy that is transmitted up to aircraft 3 along path T and which is received by a transponder device in aircraft 3 and returned along the same path T. As a result of this radar up-link transmission and the responsive beacon reply from aircraft 3, the radar is able to provide information indicating an actual target approaching the airport generally along the radar path T.

However, as a result of reflections of radar energy from adjacent structure 2, a second path exists for communication between radar 1 and incoming aircraft 3. This path comprises two links, namely, link F1 between the aircraft 3 and the adjacent structure 2 and link F2 between the radar and the adjacent structure 2. Radar energy is transmitted to the adjacent structure along link F2, and because of the reflective properties of the material comprising the portion of the structure upon which the incident radar energy impinges, the energy is reflected in many directions including along the link F1 towards the incoming aircraft 3. The aircraft beacon responds to the incident energy as if it were arriving along a direct link from the radar 1, and as a result of this additional response, a false target 4 is created such as the false target 4 located along the extension of path link F2 behind structure 2 with respect to radar 1.

Figure 6:
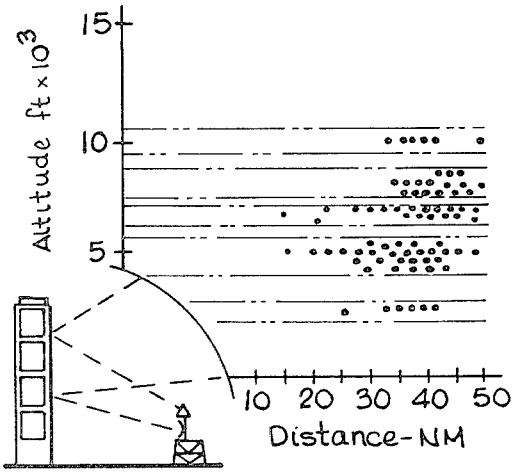
FIG. 6 is a graphical illustration of the false target problem existant at an actual radar location prior to the installation of the present invention.

Typical false target data is represented graphically in FIG. 6 which represents actual data of correlated false target occurrences as determined by an F.A.A. approach radar computer and magnetic tape recorder system at the Tulsa, Oklahoma airport. Missions which provided 16 discrete aircraft passes at altitudes between 2,500 and 10,000 feet were conducted with F-100 aircraft. FIG. 6 represents the computer correlated false target occurrences recorded on these missions which were flown before the installation of the present invention. Monitor scope observations for these missions are presented in Table I. The data shown in FIG. 6 and Table I are for only one aircraft. Clearly, peak period traffic density makes the false target problems substantially more significant.

Figure 2:
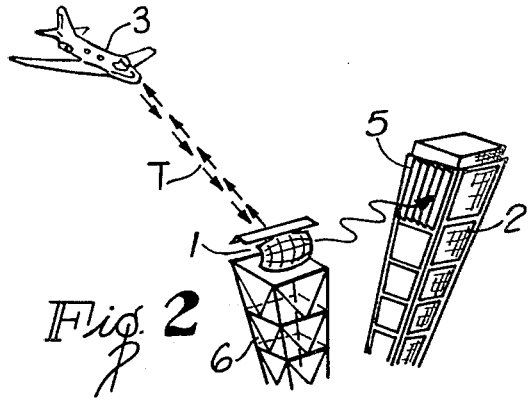
FIG. 2 is an illustrative representation indicating the manner in which the present invention may be utilized to solve the problem illustrated in FIG. 1.

Generally, the solution to the problem discussed above is illustrated in FIG. 2, which shows panels 5 of the present invention installed on the reflecting surface of the problem generating structure. Radar energy incident on that structure is, as a result of the present invention, absorbed in sufficient levels to preclude reception by the aircraft of energy at appropriate power levels to draw a beacon reply. The present invention attenuates the incident radar energy to a degree sufficient to prevent such false target replies by means of a unique passive absorber element that converts a significant percentage of incident energy, at a known frequency, into thermal energy which is then dissipated into the surrounding atmosphere.

TABLE I

| Aircraft Altitude | Average Occurrences per Pass |
|---|---|
| 2,500 | 25 |
| 3,000 | 21 |
| 4,000 | 51 |
| 5,000 | 46 |
| 6,000 | 55 |
| 7,000 | 46 |
| 8,000 | 25 |
| 10,000 | 14 |

Figure 3:
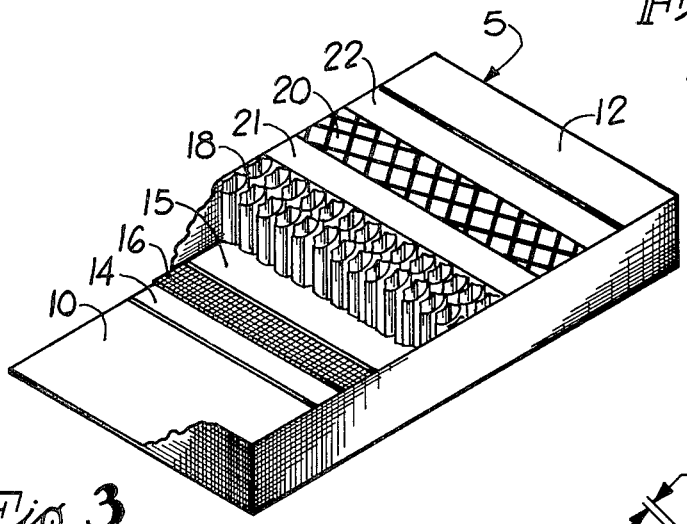
FIG. 3 is an isometric view of the structure of the present invention.
Figure 4:
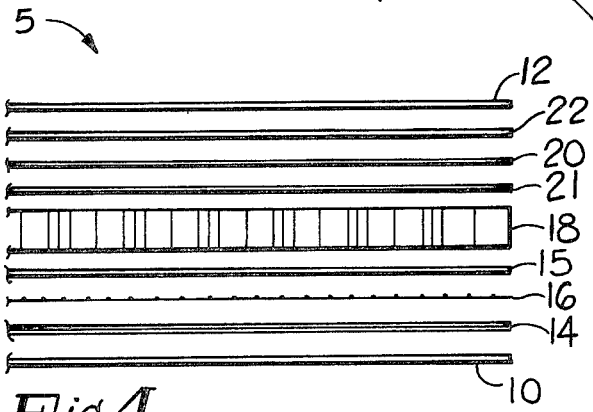
FIG. 4 is a cross-sectional exploded view of the various layers of material that comprise the present invention.

Panels 5 that are installed on the problem generating reflective structure near radar 1, comprise a multi-layer structure of selected materials and geometry which are best understood by reference to FIG. 3 and FIG. 4.

As shown in FIG. 3, the absorber element 5 of the present invention, comprises multiple layers of material including a ground plane 16 which comprises a conductive wire mesh. The ground plane is located precisely relative to an electrical component sheet 20 which comprises a dielectric substrate upon which a coating of specific conductivity and geometric shape is deposited to provide an impedance match and a lossy mechanism for conversion of incident radar energy to thermal energy. Ground plane 16 and electrical component sheet 20 are separated by a precise distance which is a function of the wavelength $\lambda$ of the incident radar energy. In the embodiment illustrated in FIG. 3, ground plane 16 and electrical component sheet 20 are separated by a spacer 18, which comprises a low dielectric material in the form of a honeycomb-shaped core which also lends structural integrity to the invention. The combination of these three elements, namely, ground plane 16, core 18 and electrical component sheet 20, is covered on both sides thereof by face-skins 14 and 22, which comprise a fiberglass-resin combination to provide structural rigidity, as well as an interface surface for transferring the internally generated thermal energy to the surrounding atmosphere. Identical face-skins 15 and 21 cover both sides of the core 18. To complete the structure, the combination is covered on both sides and along its edges by a seal material 10, 12 such as bondable TEDLAR which is a moisture impervious film that will slough snow, ice, water and dirt, for low maintenance.

It will be understood hereinafter that the geometry and thickness of the various materials comprising the layers of the absorber panel of the present invention, as well as the particular materials used, are not critical to the present invention with the following exceptions:

1. The spacing between the electrical component sheet 20 and the ground plane 16, must be balanced with the electrical characteristics of the sheet as a function of the frequency of the incident microwave energy; and
2. The electrical component sheet coating geometry provides a normalized real component of complex admittance which is substantially lossy and of appropriate match at the frequency of the incident radar energy in order to provide a structure which will convert the incident radar energy to thermal energy.

In the embodiment of the invention illustrated in FIG. 3, the spacer width is precisely 0.135λ. However, spacing may be varied within the range of 0.13λ to 0.35λ for most applications, the only constraint being that the impedance match between the atmosphere and the surface of the invention be sufficient to preclude microwave energy reflections greater than 20 dB below the incident microwave energy. In other words, the impedance match between the surface of the absorber and the atmosphere should be sufficient to provide a coefficient of reflection for incident radar energy that is equal to or less than 0.01.

The reflection coefficient R at the boundary surface and the electrical admittance on each side of the boundary surface have the following relationship:

$$R=(Y_0-Yin)/Y_0+Yin)$$

where $Y_0$ is the admittance of the atmosphere in which the radar energy is propagating and Yin is the input admittance of the invention. A simple resistive electrical sheet having a resistance of 377 ohms per square and located a quarter wavelength from a ground plane, is known in the art as a Salisbury screen absorber which is described by Salisbury in U.S. Pat. No. 2,599,944 issued June 10, 1972 and entitled "Absorbent Body For Electromagnetic Waves." The Salisbury screen in inherently limited to a narrow frequency band and geometries which are unwieldy and require excessive materials at frequencies corresponding to long wavelengths. For a more detailed discussion of the Salisbury screen, see the Antenna Engineering Handbook by Jasik, pages 32–36 and 32–37, published by McGraw Hill, 1961.

The electrical component sheet of the present invention is of complex admittance, thus enabling both broad frequency band matching and reduced thickness and material requirements. In a typical cross sectional model of an absorptive panel, which has an electrical component sheet of admittance $Y_s$ and is spaced a distance l from a ground plane and which has a dielectric spacer having an admittance $Y_1$ and a phase constant $\beta_1$, the input admittance to the absorptive panel, Yin, is the sum of $Y_s$ and $Y_1$. The objective of the panel is to sufficiently match Yin to the intrinsic admittance $Y_0$ of the environment to achieve a reflection coefficient that is less than 0.01. The input admittance $Yin_1$ at the boundary surface between the dielectric spacer and the electrical component sheet, controls the reactive component of the complex admittance of the sheet and varies with the thickness and frequency by the equation:

$$Yin_1=(Y_1+j\ Y_0\ \tan 2\beta_1 l_1)/(Y_0+j\ Y_1\ \tan 2\beta_1 l_1)$$

For an approximately lossless spacer, which can be closely achieved with materials selected for the invention, the admittance $Y_1$ of the spacer approaches infinity and $$Yin_1=Y_1/(j\ Y_1\ \tan 2\beta_1 l_1)=-j\cot 2\beta_1 l_1$$

The electrical component sheet should substantially offset the reactive component of the spacer and match the free space admittance so that for minimum reflection $$Y_s=Y_0+j\cot 2\beta_1 l_1$$

and Yin becomes $$Yin=Y_s+Y_1=Y_0+j\cot 2\beta_1 l_1-j\cot 2\beta_1 l_1$$

To the extent possible Yin is made equal to $Y_0$ to reduce the reflection coefficient below the requisite 0.01 to achieve the desired 20 dB attenuation for reflected signals.

Figure 5:
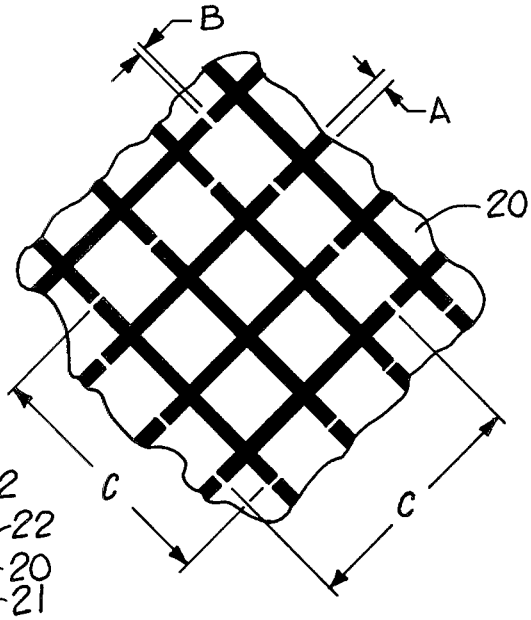
FIG. 5 is a pattern illustration of one embodiment of the electrical component sheet of the invention.

Since the geometric configuration of the electronic component sheet also affects the impedance match between the surface of the absorber material and atmosphere, the deviation between the minimum and maximum of the range of spacer dimensions mentioned above may be compensated by the geometrical configuration of the electrical component sheet. For the spacer width at 0.135, an electrical component sheet is illustrated in FIG. 5 with dimensions therein represented as a function of λ. Accordingly, dimension A equals 0.011λ, dimension B equals 0.0007λ and dimension C equals 0.1857λ.

Electrical component sheet 20 in FIG. 4 is a substrate material having a low dielectric constant and loss tangent upon which is applied a coating of carbon and polymide resin in a ratio of one to three by weight to achieve a lossy mixture. The pattern of FIG. 5 is repeated over the entire surface of the electrical component sheet and is oriented at substantially 45 degrees with respect to the horizontal and vertical coordinates of the panel so that the absorption is equally effective against linear polarization that is either horizontal or vertical and against circular polarization of eith cw or ccw sense. .

In a preferred embodiment of the present invention, which was developed specifically for operation in conjunction with the radar having a frequency of 1.03 gigahertz, dimension A is 0.125 inches, dimension B is 0.008 inches and dimension C is 2.13 inches. In addition, the spacing between the ground plane and the electrical component sheet is 1.55 inches. In that same embodiment, the various layers of material comprising the present invention have the following thicknesses: The TEDLAR seal is 0.002 inches, the bonding sheets, which are installed above and below the electrical component sheet and above and below the ground plant, are 0.010 inches, the ground plane screen is 0.020 inches, the spacing core is 1.530 inches and the electrical component sheet is 0.004 inches.

Figure 8:
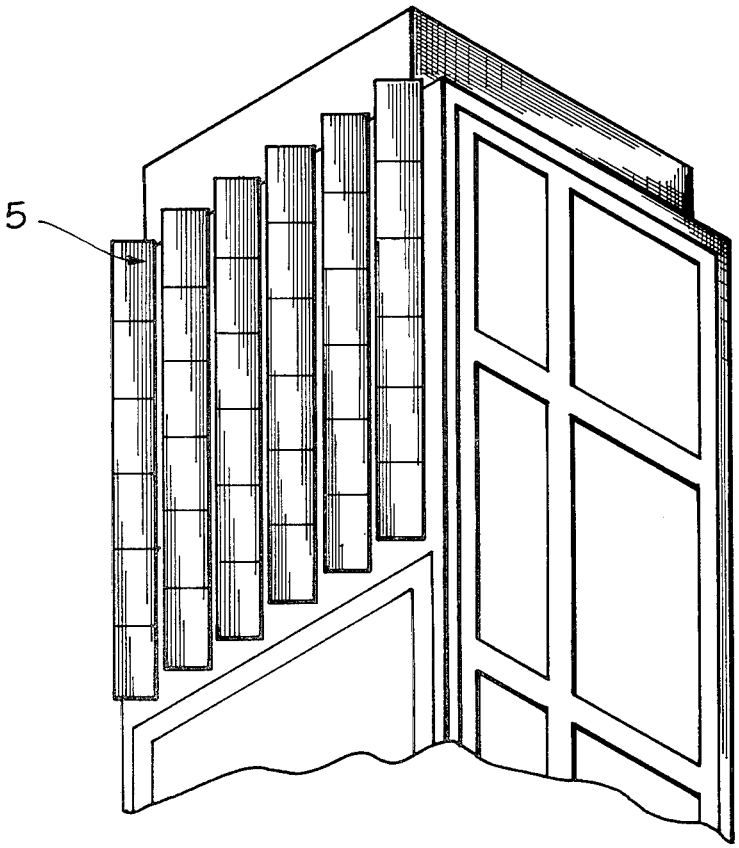
FIG. 8 is an isometric view of an actual installation of the present invention that resulted in the improved false target performance characteristics represented in FIG. 7.

In that preferred embodiment, the panels are fabricated in 3 foot by 9 foot sections and installed on the reflecting structure substantially normal to the incident radar energy as depicted in FIG. 8. As shown in FIG. 8, in order to provide a sufficient absorber covering for the reflecting surface of an airport tower located in the vicinity of the transponder radar, it was found preferrable to employ a total of 36 panels in an array that is six panels in height and 6 panels in width. Of course, it will be understood that the specific installation requirements depend upon the total surface area from which the unwanted reflections are derived and the angle between the surface of the reflecting structure and the normal to the radar antenna.

Figure 7:
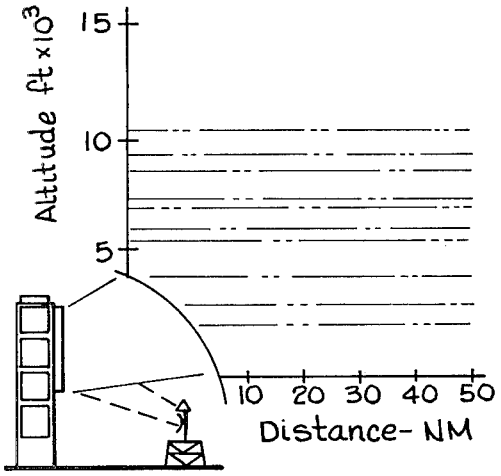
FIG. 7 is a graphical illustration similar to FIG. 6 but showing the improved false target situation subsequent to installation of the present invention.

After the installation of the preferred embodiment of the invention as depicted in FIG. 6, the evaluation flights with the same aircaft used to determine the number of false targets prior to the installation of the present invention, were repeated. The resulting performance is illustrated in FIG. 7 in which it is shown that false target occurences were completely eliminated.

It will now be understood that what has been disclosed herein is a radar energy absorbing device for converting incident radar energy into thermal energy to thereby substantially eliminate radar energy reflection which otherwise causes the presentation of false targets to an aircraft monitoring radar system.

Although a specific embodiment of the invention has been disclosed herein it will now be apparent to those having ordinary skill in the art to which the invention pertains that many other embodiments of the invention may be utilized. For example, in view of applicant's teaching herein disclosed it will now be apparent that there may be variations in dimensions and materials used to achieve the substantial impedance match at the surface of the absorber material as well as the energy converting lossyness of the electrical component sheet presented to the incident energy. Furthermore, it will be apparent that the dimensions used for determining the configuration of carbon deposit on the electrical component sheet, as well as for the spacing between that sheet and the ground plane, are substantially dependent upon the wavelength of the incident radar energy and would therefore differ for different radar frequencies. Accordingly, the invention is not to be limited except as defined by the appended claims.

I claim:

1. In an apparatus for converting incident microwave energy to thermal energy to substantially preclude reflection of the microwave energy, the apparatus having a ground plane sheet and having an electrical component sheet of admittance $Y_s$, separated from one another by a low dielectric spacer having an admittance $Y_1$, a phase constant $\beta_1$, and a thickness $l_1$; the improvement wherein said electrical component sheet comprises:

a low dielectric substrate having a coating thereon of a mixture of carbon and resin in a selected ratio and in a selected geometrical pattern, said ratio and said geometrical pattern being selected to result in an admittance $Y_s$ which is substantially defined by the following equation:

$$Y_s = Y_0 + j \cot 2\beta_1 l_1$$

where $Y_0$ is the intrinsic admittance of the environment in the vicinity of said apparatus.

2. The apparatus as defined in claim 1, further comprising: face-skins comprising a fiberglass resin combination, one such face-skin covering each surface of said spacer and one such face-skin covering each oppositely facing surface of said electrical component sheet and said ground plane sheet, respectively.

3. An apparatus as defined in claim 1, further comprising a moisture impervious film entirely enclosing said combination.

4. An apparatus as defined in claim 1, wherein said selected geometrical pattern comprises a repeated rectangular grid, each such grid comprising a plurality of substantially perpendicular crossing paths.

5. The apparatus as defined in claim 1, wherein said selected ratio of carbon and resin is 1 to 3 by weight.

6. The apparatus as defined in claim 1, wherein the impedance match between the apparatus and the surrounding atmosphere is such as to provide a coefficient of reflection for incident microwave energy that is no greater than 0.01.

7. An apparatus for converting incident microwave energy of known wavelength $\lambda$ into thermal energy, the apparatus comprising in combination:

an electrical component sheet having a low dielectric substrate material coated with a selected geometrical pattern of a mixture of carbon and resin in a selected ratio, a ground plane sheet substantially parallel to said electrical component sheet, and a spacer of low dielectric material, separating said electrical component sheet from said ground plane sheet, the thickness of said spacer being a precise function of the wavelength $\lambda$, said selected geometrical pattern comprising a repeated rectangular grid, each such grid comprising a plurality of substantially perpendicular crossing paths, the overall dimension of each said grid being in the range of $18\times10^{-2}\,\lambda$ to $20\times10^{-2}\,\lambda$ on each side thereof, the width of said paths being approximately $10^{-2}\,\lambda$, and the separation between grids being substantially within the range of $5\times10^{-4}\,\lambda$ to $10^{-3}\lambda$.

8. An apparatus for eliminating radar false targets by converting incident microwave electromagnetic energy into thermal energy to preclude reflection of incident radar transmissions which would otherwise induce the generation of a beacon response flase target from an aircraft being tracked by said radar, the apparatus being in a layered, sandwich configuration comprising in combination:

an electrical component sheet having a coating of a combination of carbon and polymide resin in a selected ratio by weight on a substrate of low dielectric constant and loss tangent, said coating being in a selected geometrical configuration to provide a lossy mixture, a ground plane sheet comprising a conductive wire mesh located substantially parallel to said electrical component sheet, said electrical component sheet and said ground plane sheet being separated by means of a spacer core comprising a low dielectric material of substantial structural rigidity, the thickness of which is a function of the frequency of the incident radar energy, said selected geometrical pattern comprising a repeated rectangular grid, each such grid comprising a plurality of substantially perpendicular crossing paths, the overall dimension of each such grid being in the range of $18\times10^{-2}\lambda$ to $20\times10^{-2}\lambda$ on each side thereof, the width of said paths being approximately $10^{-2}\lambda$, and the separation between grids being substantially within the range of $5\times10^{-4}\lambda$ to $10^{-1}\lambda$.

* * * * *